US008024896B2

(12) United States Patent
Azarin

(10) Patent No.: US 8,024,896 B2
(45) Date of Patent: Sep. 27, 2011

(54) ANCHOR RECESS FORMER

(76) Inventor: Michael Azarin, Alpharetta, GA (US)

( * ) Notice: Subject to any disclaimer, the term of this patent is extended or adjusted under 35 U.S.C. 154(b) by 116 days.

(21) Appl. No.: 12/033,375

(22) Filed: Feb. 19, 2008

(65) Prior Publication Data

US 2009/0183441 A1 Jul. 23, 2009

Related U.S. Application Data

(60) Provisional application No. 60/890,997, filed on Feb. 21, 2007.

(51) Int. Cl.
*E04B 1/38* (2006.01)
*E04B 1/41* (2006.01)

(52) U.S. Cl. ..... 52/125.4; 52/125.5; 52/125.1; 52/677

(58) Field of Classification Search ..... 52/125.1, 52/124.2, 125.4, 125.5, 125.2, 125.6, 677, 52/688, 687, 689
See application file for complete search history.

(56) References Cited

U.S. PATENT DOCUMENTS 1,146,686 A * 7/1915 Branch ..... 52/711
3,705,469 A * 12/1972 Eriksson ..... 52/125.4
4,000,591 A * 1/1977 Courtois ..... 52/689
4,133,154 A * 1/1979 Ruzicka ..... 52/298
4,367,892 A * 1/1983 Holt ..... 294/89
4,437,642 A * 3/1984 Holt ..... 249/175
4,443,980 A * 4/1984 Pennypacker ..... 52/125.4
4,580,378 A * 4/1986 Kelly et al. ..... 52/125.5
4,807,843 A * 2/1989 Courtois et al. ..... 249/61
4,821,994 A * 4/1989 Fricker ..... 249/91
5,094,047 A * 3/1992 Kelly et al. ..... 52/125.5
5,226,265 A * 7/1993 Kelly et al. ..... 52/125.6
6,023,891 A * 2/2000 Robertson et al. ..... 52/125.4
6,279,274 B1 * 8/2001 Amiet et al. ..... 52/125.2
6,460,824 B1 * 10/2002 Lancelot et al. ..... 249/91
6,550,834 B2 * 4/2003 Fromelius ..... 294/89
6,575,424 B2 * 6/2003 Domizio ..... 249/91
6,688,049 B2 * 2/2004 Sanftleben et al. ..... 52/125.4
6,769,663 B2 * 8/2004 Kelly et al. ..... 249/91
6,779,312 B2 * 8/2004 Wright ..... 52/125.5
6,817,156 B2 * 11/2004 Mok ..... 52/699
6,910,309 B2 * 6/2005 Trangsrud ..... 52/685
7,127,859 B2 * 10/2006 Domizio ..... 52/576
7,137,609 B2 * 11/2006 Sack ..... 249/91
7,780,122 B1 * 8/2010 Herbers ..... 248/59
2002/0062604 A1 * 5/2002 Fromelius ..... 52/125.5
2003/0140576 A1 * 7/2003 Sanftleben ..... 52/125.4
2004/0010984 A1 * 1/2004 Wright ..... 52/125.4
2005/0183349 A1 * 8/2005 Hansort ..... 52/125.4
2007/0062130 A1 * 3/2007 Sack ..... 52/125.5
2007/0186492 A1 * 8/2007 Bennett et al. ..... 52/125.4
(Continued)

*Primary Examiner* — Phi Dieu Tran A
(74) *Attorney, Agent, or Firm* — Laurence P. Colton; Smith Risley Tempel Santos LLC

(57) ABSTRACT

A device that attaches to the rebar used to manufacture a concrete item and is left in place as the wet concrete is placed within the form for the concrete item and allowed to cure. The device is a hollow, walled, generally cup- or half disc-shaped structure having an outer forming wall and a hollow interior. The device may be a unitary or two part construction having an upper section, a lower section, upper rebar braces, lower rebar braces, and anchor holes. Anchor holes extend through the anchor recess former providing for a passage from the hollow interior to the outside. Upon the curing of the concrete, the present invention becomes an integral part of the concrete item, creating a uniform recess and exposing an anchor that can be used to lift the concrete item.

18 Claims, 13 Drawing Sheets

U.S. PATENT DOCUMENTS

2008/0104897 A1* 5/2008 Lang ..... 52/125.4
2009/0107057 A1* 4/2009 Hansort ..... 52/125.4
2009/0320386 A1* 12/2009 Mackay Sim ..... 52/125.4
2010/0011678 A1* 1/2010 Kelly ..... 52/125.5

* cited by examiner

ANCHOR RECESS FORMER

STATEMENT OF RELATED APPLICATIONS

This application is based on and claims priority on U.S. Provisional Patent Application No. 60/890,997 having a filing date of 21 Feb. 2007, which is incorporated herein by this reference in its entirety.

BACKGROUND OF THE INVENTION

1. Field of the Invention

The present invention generally relates to anchor recess formers for concrete items. The present invention also relates to an anchor recess former for use in concrete items such as manholes. The present invention more specifically relates to anchor recess formers that provide for holding an anchor in a desired position during the formation of the concrete item. The present invention also more specifically relates to anchor recess formers that are simple to attach to the reinforcement bars used in concrete items such that after the concrete item cures, the anchor recess is properly positioned and the anchor is available for use.

2. Description of the Related Art

Large concrete items such as pre-formed manholes need to be lifted for transportation. Forklifts can be used for smaller items; however, larger items often must be lifted by crane. Such large concrete items often are formed with anchor recesses to allow a crane with a hook to lift the concrete item. An anchor recess is an indentation in the concrete structure allowing access to an anchor embedded in the concrete item. Such recesses and anchors are known in the art.

Current anchor recess formers are rubber devices used to create a recess in the concrete item and then which are removed from the concrete item prior to use. One example of a current anchor recess system can be found at www.conacweb.com/anchors.htm. A magnet is attached to the rubber recess former device to attach the rubber recess device to the steel reinforcement bars (rebar) contained in the concrete structures. Rebar improves the strength of concrete in tension. When forming a concrete item, rebar is laid in the desired pattern prior to the pouring of the concrete. The concrete then is poured about the rebar and allowed to harden about the rebar. The rebar increases the strength of the cured concrete item.

Because the rubber recess former devices are attached to the rebar only by a magnet, the rubber recess former devices can move during the formation of the concrete item, resulting in a crooked recess, concrete seeping into the recess and negatively affecting the ability to lift the concrete item, uneven placement of the lifting means, and uneven load carrying, all of which can result in damage to the concrete item or nearby items and people.

Thus, there is a need for an improved anchor recess former device and system. It is to such an anchor recess former device and system that the present invention is primarily directed.

BRIEF SUMMARY OF THE INVENTION

The present invention is an anchor recess former for use in forming recesses in concrete items. The recesses expose an anchor that can be used to lift the concrete item. Briefly, the present invention is a device that attaches to the rebar used to manufacture the concrete item and is left in place as the wet concrete is placed within the form for the concrete item and allowed to cure. Upon the curing of the concrete, the present invention becomes an integral part of the concrete item, creating a uniform recess and exposing an anchor that can be used to lift the concrete item.

The present invention is an anchor recess former and structurally is a hollow, walled, generally cup- or half disc-shaped structure having an outer forming wall and a hollow interior. The anchor recess former preferably comprises an upper section, a lower section, upper rebar braces, lower rebar braces, and anchor holes. The upper rebar braces are attached to the outer curved rear surface of the upper section via upper brace supports, and the lower rebar braces are attached to the outer curved rear surface of lower section via lower brace supports. Anchor holes extend through the anchor recess former providing for a passage from the hollow interior to the outside. The upper section and the lower section can be separate pieces separated by split, a single hinged piece having at least one hinge connecting the upper section and the lower section located along the front edge, or a single piece construction having a slot extending from the front edge of the anchor recess former and extending to the anchor holes.

A faceplate also can be used to connect the upper section to the lower section. Optional faceplate attachment dimples allow the faceplate to be attached to the anchor recess former. The faceplate also prevents concrete and other unwanted material from entering the recess during the production and transportation of the concrete item. Additionally, the faceplate may have protrusions extending inwardly into the hollow interior of the anchor recess former to position and support the anchor in a preferred position when the concrete cures.

An anchor is a steel or similar item embedded in a concrete item that is used to lift the concrete item. Both the anchor and its use are known in the art. The anchor is placed within the anchor recess former with the apex of the anchor pointing forward (towards the front or front edge of the anchor recess former), with the anchor shanks fitting in the anchor holes, and with the anchor stops outside of the anchor recess former so as to be embedded in the concrete item when the concrete is poured and hardened. The faceplate can be snapped in place covering the opening of the anchor recess former, with the protrusions supporting the anchor in a preferred position, such as generally normal to the side of the concrete item in which the anchor recess former is embedded.

In a first embodiment the upper section and the lower section can be separated from each other, pivoted relative to each other, or otherwise opened relative to each other so as to allow the placement of the anchor in a proper position with the apex of the anchor and portions of the anchor shanks within the hollow interior and portions of the shanks and stops outside of the anchor recess former. If the anchor recess former does not have the faceplate attached or hinges between the upper section and the lower section, then the upper section and the lower section can be separated from each other and the anchor inserted so as to be seated within the anchor holes. If the anchor recess former has the faceplate attached, then the upper section and the lower section can be flexed opened (split apart) by the bending of the faceplate, and the anchor inserted so as to be seated within the anchor holes, presuming the faceplate is of a flexible material. If the anchor recess former has hinges, then the upper section and the lower section can be hinged opened (split apart), and the anchor inserted so as to be seated within the anchor holes.

In a second embodiment, if the anchor recess former is of a slotted, single piece construction, the anchor is inserted into the slot so that the shanks proximal to the apex are retained in the anchor holes. In this instance, the faceplate also will preferably have inwardly extending arms so as to cover the slot openings to avoid infiltration of the poured concrete into the hollow interior of the anchor recess former. The faceplate also preferably comprises an anchor alignment post or protrusions provided on the surface of the faceplate facing the hollow interior of the anchor recess former to retain the apex of the anchor in proper alignment during pouring and setting of the concrete.

In operation and use, a anchor recess former is manufactured into a concrete item. During the manufacturing process, the faceplate preferably is maintained on the anchor recess former to prevent concrete, water, other debris from entering the hollow interior. Once the concrete item has been manufactured, upon the need to lift the concrete item, the faceplate is removed and a lifting assembly is used to lift the concrete item. The concrete item then can be placed on a truck for transportation, or moved or removed to a desired location.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF EMBODIMENTS OF THE INVENTION

With reference to the figures in which like numerals represent like elements throughout, embodiments of the present invention are shown. The figures and the following description are for a limited number of embodiments for ease of understanding. However, the invention is not limited to these illustrative embodiments.

Figure 1:
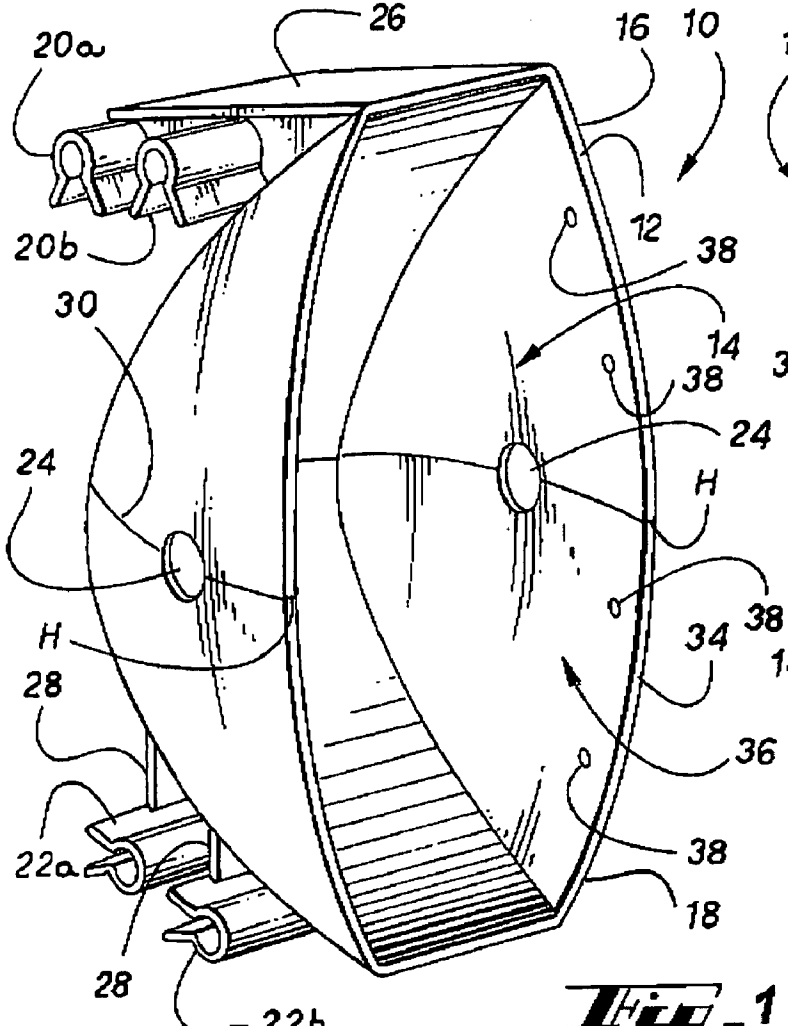
FIG. 1 is a perspective view of an embodiment of the anchor recess former of the present invention.

Referring now to FIG. 1, a perspective view of an embodiment of the anchor recess former 10 of the present invention is shown. The anchor recess former 10 is a hollow, walled, generally cup- or half disc-shaped structure having an outer forming wall 12 and a hollow interior 14. The anchor recess former 10 preferably comprises an upper section 16, a lower section 18, upper rebar braces 20A, 20B, lower rebar braces 22A, 22B, and anchor holes 24. Upper rebar braces 20 are attached to the outer curved rear surface 44 (see FIG. 3) of upper section 16 via upper brace supports 26, and lower rebar braces 22 are attached to the outer curved rear surface 46 (see FIG. 3) of lower section 18 via lower brace supports 28. Anchor holes 24 extend through the anchor recess former 10 providing for a passage from the hollow interior 14 to the outside. In this embodiment, upper section 16 and lower section 18 can be separate pieces separated by split 30, or can be a single hinged piece having at least one hinge (not shown) connecting upper section 16 and lower section 18 located along front edge 34 generally at approximately position H. As can be seen, front edge 34 is located along a contiguous portion of side walls of the outer forming wall 12 and the rear surface 44 wall. Optional faceplate attachment dimples 38 allow faceplate 40 (shown in later FIGs.) to be attached to the anchor recess former 10.

Although the size of the anchor recess former 10 can be determined by those of skill in the art for various different uses, the preferred multi-use size is approximately 9.5" high by approximately 3.0" wide by approximately 3.5" deep. A suitable size range is in the 6" to 13" high range by 1.5" to 4.5" wide range by 2" to 5" deep range. Other sizes can be suitable for specific uses and circumstances. The preferred anchor recess former 10 is constructed from a plastic or other polymer for ease of forming, light weight, and cost benefits, although other materials of construction are contemplated, such as metal, rubber, composites, carbon or graphite fiber materials, ceramics, and the like.

Figure 2:
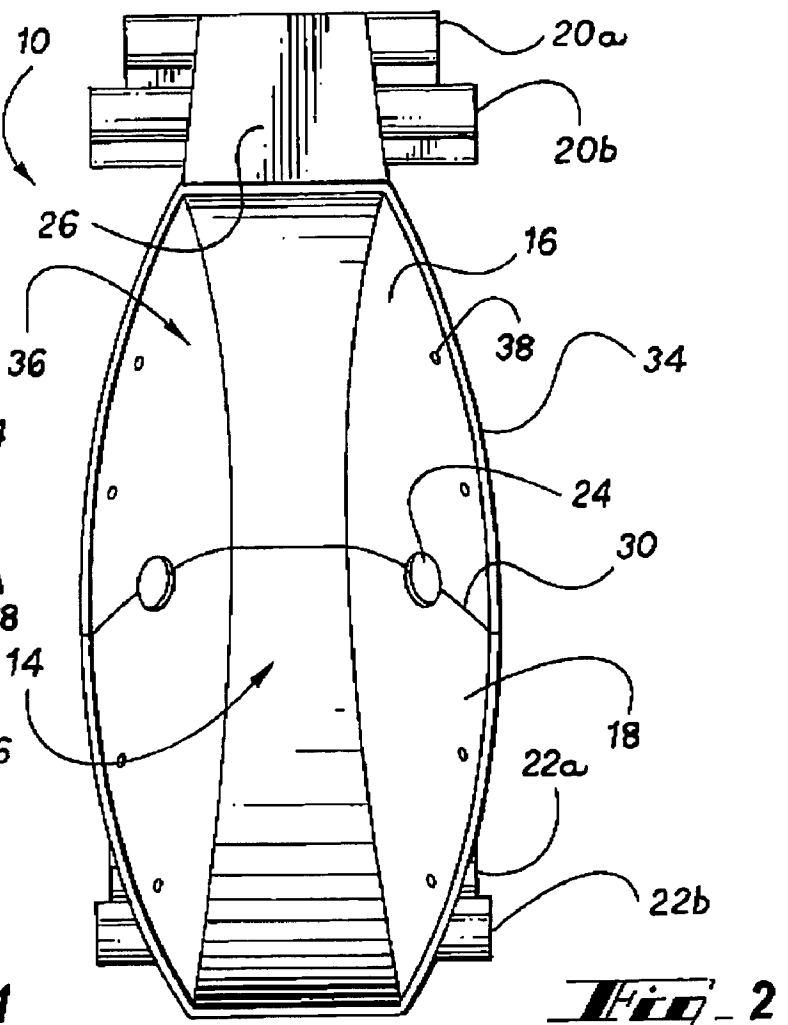
FIG. 2 is a front view of the embodiment of the present invention shown in FIG. 1.

Referring now to FIG. 2, a front view of an embodiment of the present invention is shown from a slightly elevated angle so as to show the top of the anchor recess former 10. From this view, it can be seen that anchor holes 24 are generally opposite each other across the hollow interior 14 and straddle split 30. More specifically, top half of each anchor hole 24 is located on upper section 16 and bottom half of each anchor hole 24 is located on lower section 18. Split 30 extends all the way around the anchor recess former 10 (with an exception of hinges, if present) and generally splits the anchor recess former 10 in half horizontally such that upper section 16 and lower section 18 are generally mirror images of each other (with an exception of the construction and placement of braces 20, 22 and supports 26, 28. Although opening 36 leading to hollow interior 14 is shown as an oval with flattened top and bottom, the shape of opening 36, and thus anchor recess former 10, is variable and not limited to the illustrative shape shown in the drawings.

Figure 3:
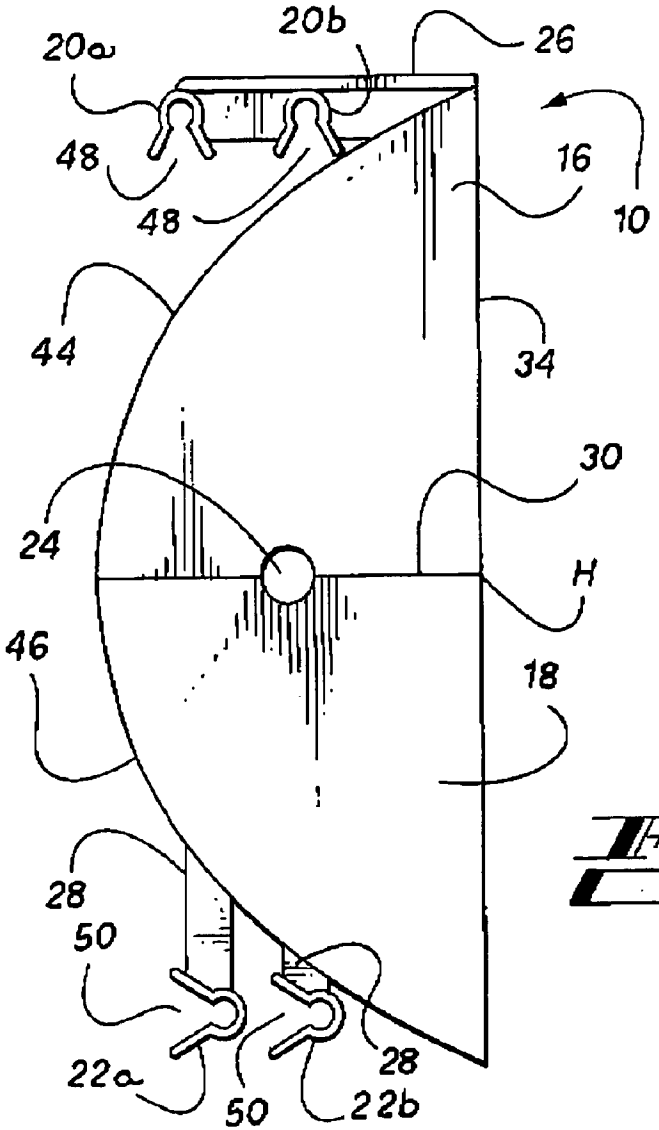
FIG. 3 is a side view of the embodiment of the present invention shown in FIG. 1.

Referring now to FIG. 3, a side view of an embodiment of the present invention is shown. Upper brace supports 26 are attached to the outer curved rear surface 44 of upper section 16. Upper brace supports 26 extends horizontally rearwardly a predetermined distance from the front edge 34, thus supporting upper rebar braces 20 at specific distances from front edge 34. Similarly, lower brace supports 28 are attached to the outer curved rear surface 46 of lower section 18. Lower brace supports 28 extend vertically downwardly a predetermined vertical distance relative to the position of upper rebar braces 20 and a predetermined horizontal distance from front edge 34, thus supporting lower rebar braces 22A, 22B at specific distances from both corresponding upper rebar braces 20A, 20B and front edge 34. For reasons disclosed in connection with FIG. 17, upper open mouths 48 of upper rebar braces 20 open downwardly and lower open mouths 50 of lower rebar braces 22 open rearwardly. Front edge 34 in this embodiment is generally planar.

Figure 4:
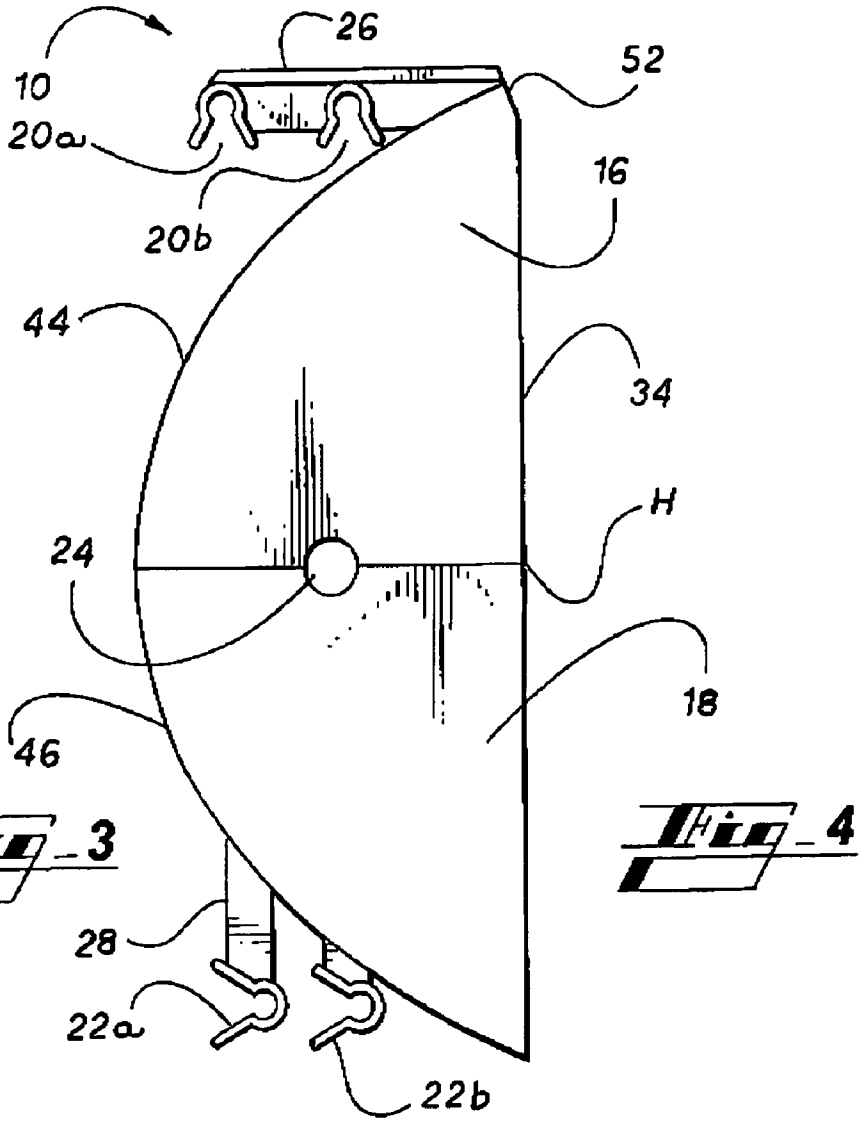
FIG. 4 is a side view of another embodiment of the present invention.

Referring now to FIG. 4, a side view of another embodiment of the present invention is shown. Front edge 34 in this embodiment also is generally planar, but comprises angled notch 52. As disclosed in connection with FIG. 15, notch 52 can allow for easier placing of concrete item form 102 (see FIG. 15) over rebar pattern 100 (see FIG. 15). More specifically, using notch 52 provides a more contoured upper edge for the anchor recess former 10 and presents a smaller upper edge upon which concrete item form 102 can catch.

Figures 5, 6, 7:
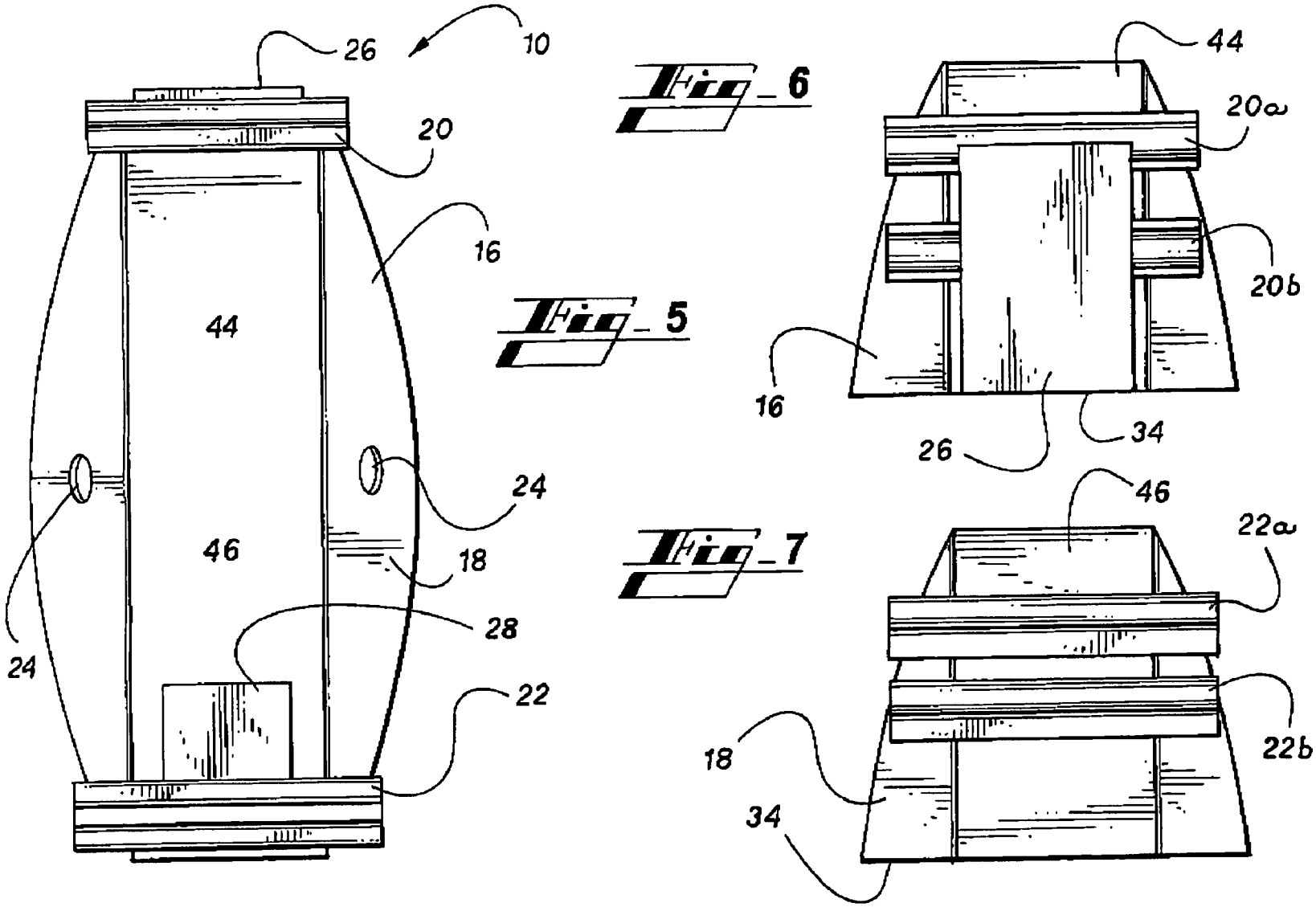
FIG. 5 is a rear view of the embodiment of the present invention shown in FIG. 1.
FIG. 6 is a top view of the embodiment of the present invention shown in FIG. 1.
FIG. 7 is a bottom view of the embodiment of the present invention shown in FIG. 1.

Referring now to FIG. 5, a rear view of an embodiment of the present invention is shown. Upper rebar braces 20 and lower rebar braces 22 are shown as being within the vertical height footprint of the anchor recess former 10, that is, upper rebar braces 20 are located at or below the top of front edge 34 and lower rebar braces 22 are located at or above the bottom of front edge 34. Although this placement is preferred, it is not necessary so long as upper rebar braces 20 and lower rebar braces 22 are located a specific vertical distance from each other corresponding to the distance between rebar 104 (see FIG. 15) in rebar pattern 100 (see FIG. 15). This distance is a standard distance in the art. In this view, lower open mouth 50 can be seen opening rearwardly.

Referring now to FIG. 6, a top view of an embodiment of the present invention is shown. Upper rebar braces 20 are attached to the anchor recess former 10 generally horizontally and generally parallel to the plane of front edge 34. Upper rebar braces 20 are located a predetermined distance from front edge 34, which distance is determined by the standard construction of rebar pattern 100 (see FIG. 15). In turn, the standard construction of rebar pattern 100 (see FIG. 15) is known in the art and is called for in various standard specifications. For example, the final size and shape of the concrete item 98 (see FIG. 15) dictates the rebar pattern 100 (see FIG. 15) and therefore the pattern and spacing of the rebar 104 (see FIG. 15) in rebar pattern (see FIG. 15). In the illustrative embodiment shown, second upper rebar brace 20B is located 1" from front edge 34 and first upper rebar brace 20A is located 2"from front edge 34. The reason for these distances is disclosed in connection with FIGS. 15 and 16.

Referring now to FIG. 7, a bottom view of an embodiment of the present invention is shown. Lower rebar braces 22 are attached to the anchor recess former 10 generally horizontally and generally parallel to the plane of front edge 34. Lower rebar braces 22 are located a predetermined distance from front edge 34, which distance is determined by the standard construction of rebar pattern 100 (see the disclosure in connection with FIG. 6). In the illustrative embodiment shown, second lower rebar brace 22B is located 1" from front edge 34 and first upper rebar brace 22A is located 2" from front edge 34. The reason for these distances is disclosed in connection with FIGS. 15 and 16.

Figure 8:
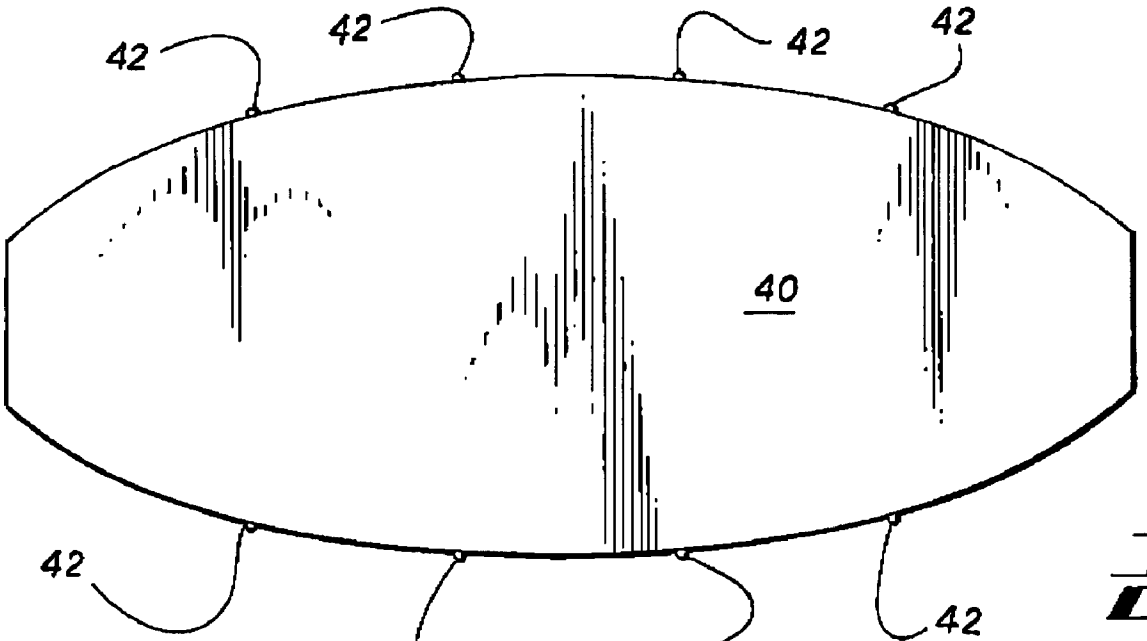
FIG. 8 is a front view of an embodiment of a faceplate cover for the present invention.

Referring now to FIG. 8, a front view of an embodiment of a faceplate 40 cover for the present invention is shown. Faceplate 40 has the same general shape of opening 36 and is structured to fit within opening 36. More specifically, faceplate 40 is meant to cover opening 36 so as to prevent or reduce unwanted materials from entering hollow interior 14. At least one nub 42 is located along the periphery of faceplate 40. Nubs 42 cooperate with dimples 38 on anchor recess former 10 to hold faceplate 40 within anchor recess former 10. Nubs 42 and dimples 38 preferably are structured to securely but removably hold faceplate 40 within anchor recess former 10. Faceplate 40 preferably is constructed from a plastic or other polymer for ease of forming, light weight, and cost benefits, although other materials of construction are contemplated, such as metal, rubber, composites, carbon or graphite fiber materials, ceramics, and the like.

Figure 9:
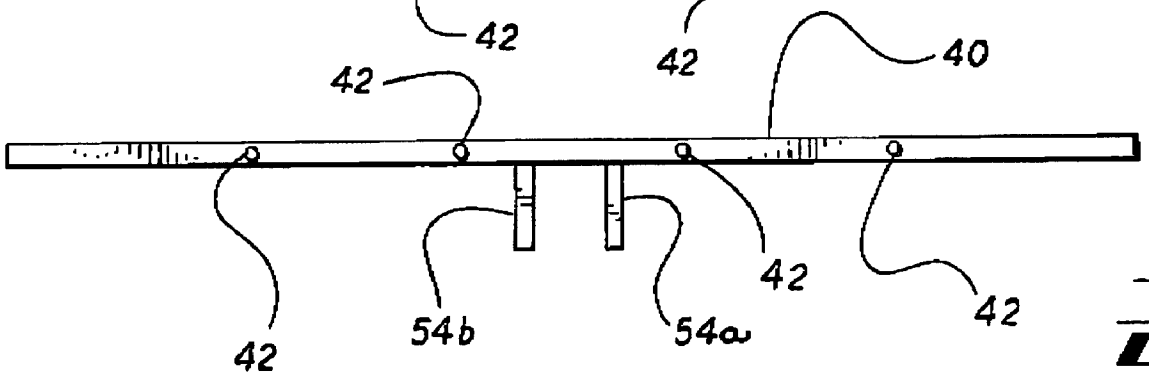
FIG. 9 is a side view of the embodiment of the faceplate cover for the present invention shown in FIG. 8.

Referring now to FIG. 9, a side view of an embodiment of the faceplate 40 cover for the present invention is shown. Faceplate 40 is a generally planar structure and comprises anchor supports 54 extending horizontally and perpendicularly from faceplate 40. When faceplate 40 is attached to anchor recess former 10, anchor supports 54 extend and are located within hollow interior 14 at a height sufficient to support anchor 96 (see FIG. 14) within anchor recess former 10 so as to prevent anchor 96 from moving during the manufacturing of the concrete item 98. More specifically, the distance between upper anchor support 54A and lower anchor support 54B is approximately the same as the thickness of anchor 96 (see FIG. 14) such that the apex A (see FIG. 14) fits between anchor supports 54.

Figures 10, 11:
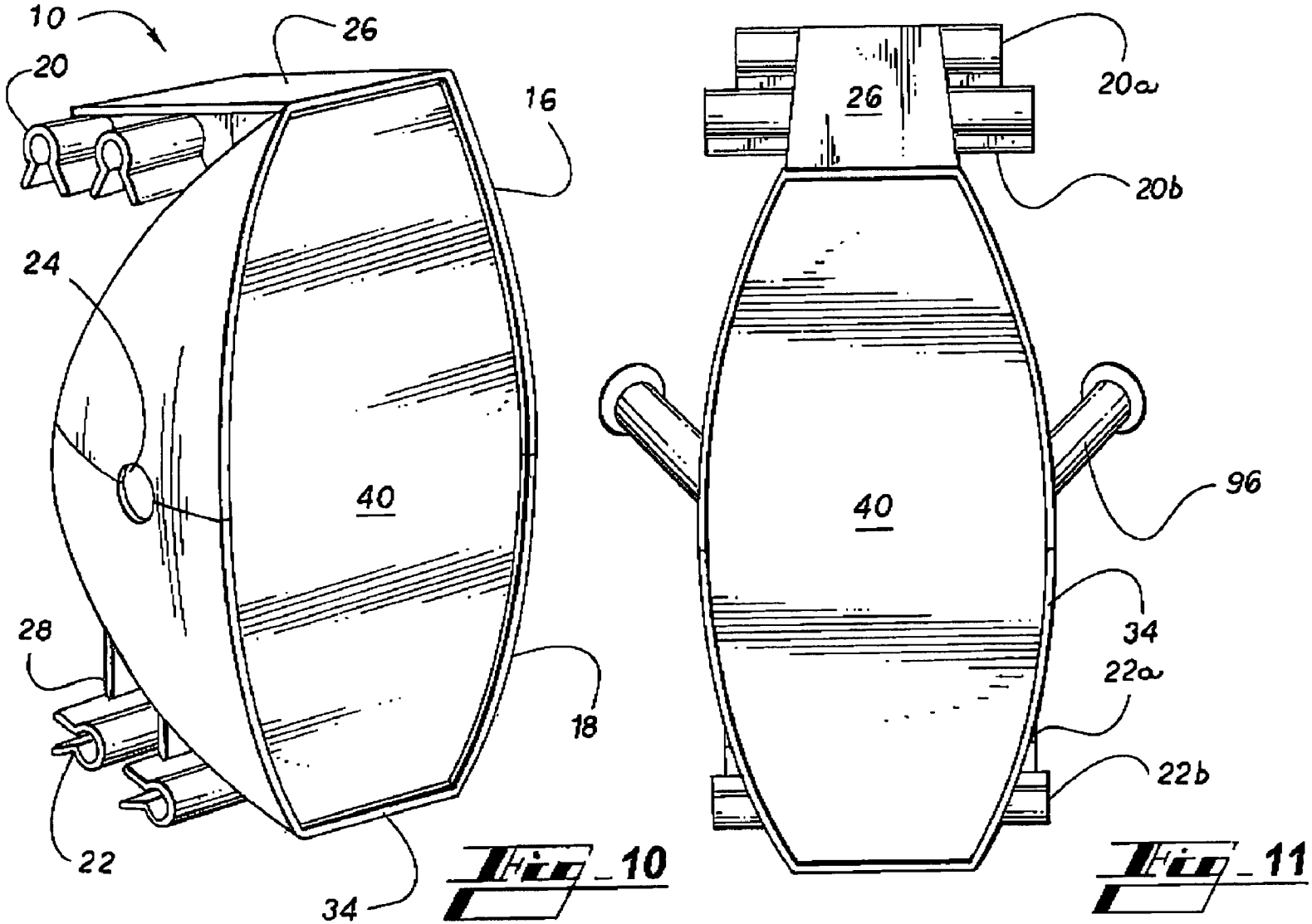
FIG. 10 is a perspective view of the embodiment of the present invention shown in FIG. 1 with the embodiment of the cover shown in FIG. 8.
FIG. 11 is a front view of the embodiment of the present invention shown in FIG. 1 with the embodiment of the cover shown in FIG. 8.

Referring now to FIG. 10, a perspective view of an embodiment of the present invention with an embodiment of the faceplate 40 cover is shown. Faceplate 40 fits within the opening 36 to the hollow interior 14 of the anchor recess former 10 so as to provide a cover for the anchor recess former 10. Faceplate 40 helps prevent or reduce unwanted materials from entering hollow interior 14. For example, during the manufacturing process of the concrete item 98, concrete can enter anchor recess former 10. Faceplate 40 helps prevent or reduce concrete from entering the hollow interior 14. For another example, during shipping and storage, water and dirt can enter anchor recess former 10. Faceplate 40 also helps prevent or reduce water and dirt from entering hollow interior 14.

Referring now to FIG. 11, a front view of an embodiment of the present invention with an embodiment of the faceplate 40 cover is shown. Anchor 96 is shown to illustrate that faceplate 40 also covers access to anchor 96. Anchor 96 is a steel or similar item embedded in a concrete item 98 that is used to lift concrete item 98. Both anchor 98 and its use are known in the art.

Figures 12, 13:
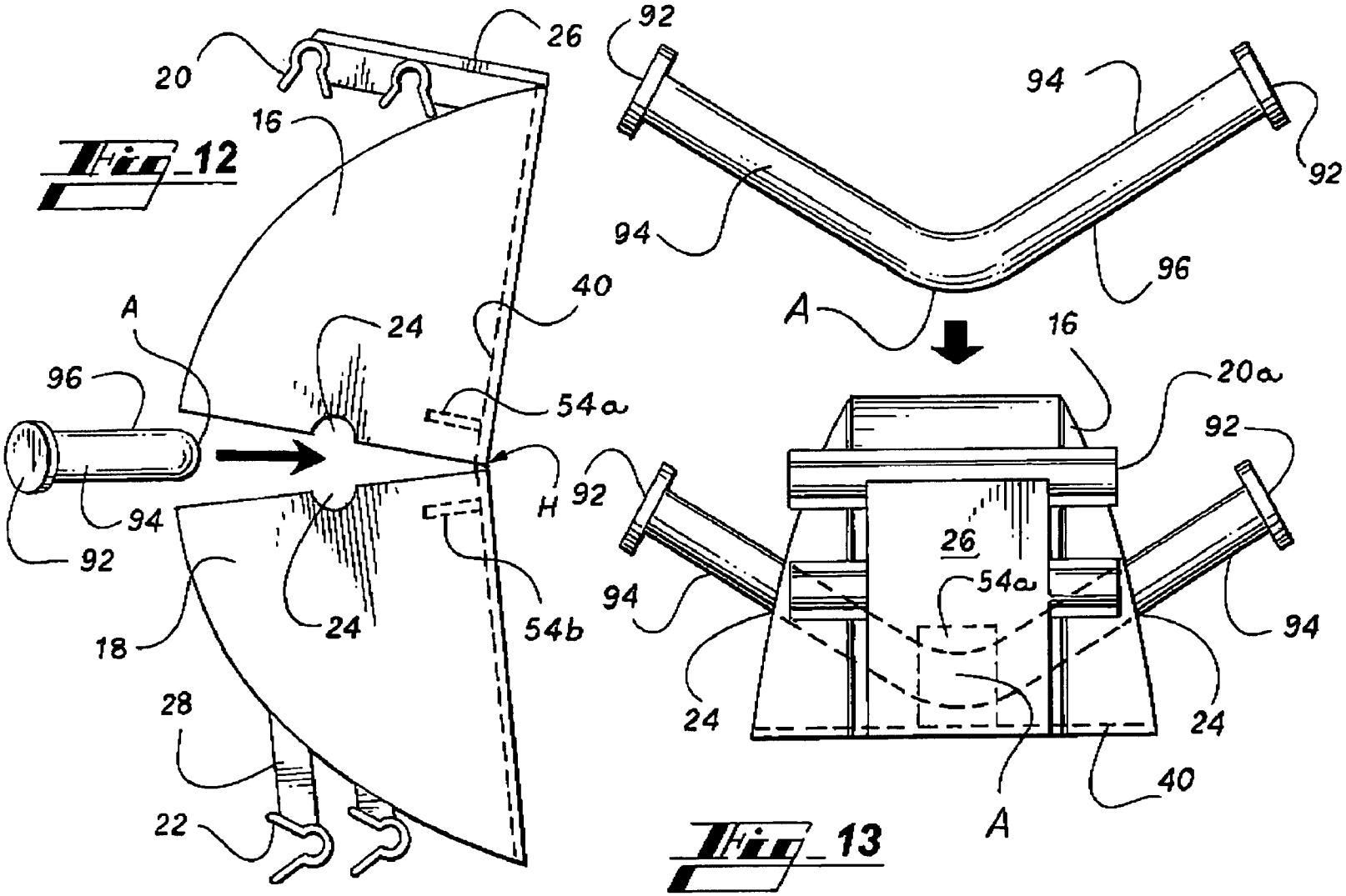
FIG. 12 is a side view of the embodiment of the present invention shown in FIG. 1 being opened for the reception of an anchor.
FIG. 13 is a top view of the embodiment of the present invention shown in FIG. 1 being opened for the reception of an anchor.

Referring now to FIG. 12, a side view of an embodiment of the present invention being opened for the reception of an anchor 96 is shown. Anchor 96 is placed within anchor recess former 10 with anchor apex A pointing forward (towards the front or front edge 34 of anchor recess former), shanks 94 fitting in anchor holes 24, and stop 92 outside of anchor recess former 10 so as to be embedded in concrete item 98. Faceplate 40 is shown in ghost lines. When anchor 96 is inserted fully into anchor recess former 10, anchor apex A will fit within and between anchor supports 54.

Upper section 16 and lower section 18 can be separated from each other, pivoted relative to each other, or otherwise opened relative to each other so as to allow the placement of anchor 96 in a proper position with apex A and portions of shanks 94 within hollow interior and portions of shanks 94 and stops 92 outside of anchor recess former 10. If the anchor recess former 10 does not have the faceplate 40 attached or hinges (not shown) between upper section 16 and lower section 18, then upper section 16 and lower section 18 can be separated from each other and anchor 96 inserted. However, this may result in a difficulty in maintaining upper section 16 and lower section 18 together. If the anchor recess former 10 has the faceplate 40 attached, then upper section 16 and lower section 18 can be flexed opened (split apart) by the bending of faceplate 40, and anchor 96 inserted, presuming faceplate 40 is of a flexible material. The elasticity of faceplate 40 then will urge upper section 16 and lower section 18 back into a closed (together) position, thus securing anchor 96 in the proper position. If the anchor recess former 10 has hinges (not shown, but in a location proximal to H), then upper section 16 and lower section 18 can be hinged opened (split apart), and anchor 96 inserted. Hinges can have elasticity so as to urge upper section 16 and lower section 18 together, thus securing anchor 96 in the proper position. Additionally, if the anchor recess former 10 has both hinges and the faceplate 40, then the elasticity of the faceplate 40 will urge upper section 16 and lower section 18 back into a closed (together) position, thus further securing anchor 96 in the proper position.

Referring now to FIG. 13, a top view of an embodiment of the present invention being opened for the reception of an anchor 96 is shown. Anchor 96 is inserted generally centrally into anchor recess former 10. The proper positioning of anchor 96 within anchor recess former 10 is shown in ghost lines. Apex A is located between anchor supports 54, and anchor shanks 94 extend outwardly through anchor holes 24.

Figure 14:
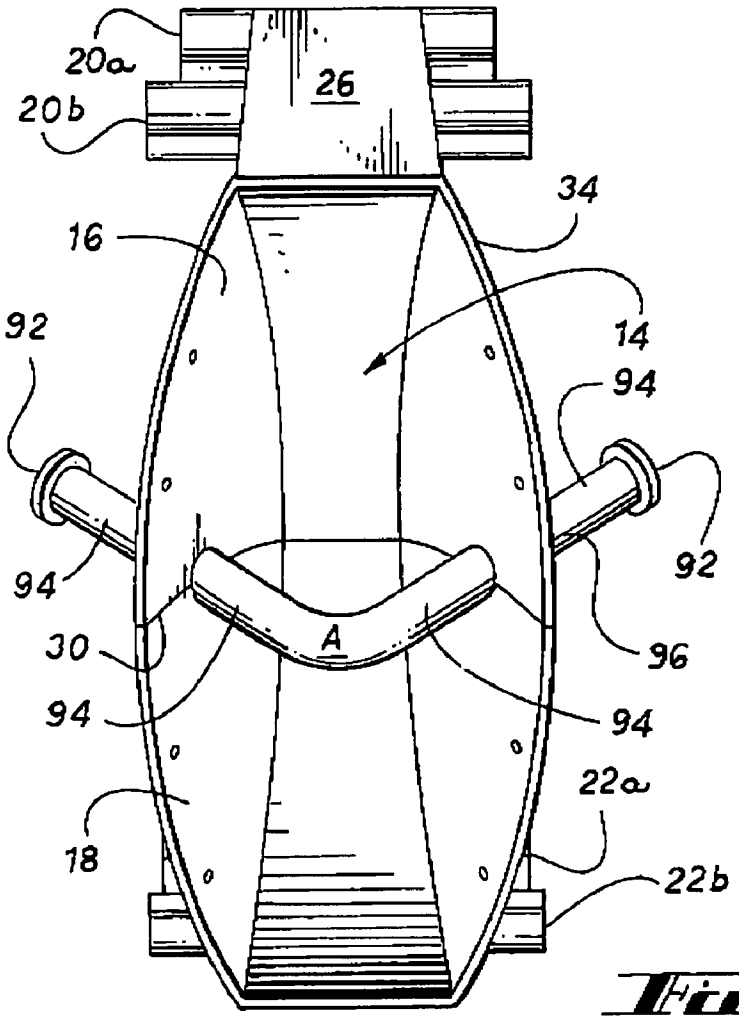
FIG. 14 is a front view of the embodiment of the present invention shown in FIG. 1 with an anchor.

Referring now to FIG. 14, a front view of an embodiment of the present invention with an anchor 96 is shown. Apex A is located within hollow interior 14, anchor shanks 94 extend outwardly and rearwardly through anchor holes 24, and anchor stops 92 are outside of anchor recess former 10. As will be disclosed in more detail in connection with FIGS. 18 and 19, this configuration allows for apex to be within hollow interior and available for cooperation with lifting assembly 110, while anchor stops are securely embedded within concrete item 98.

Figures 21, 22:
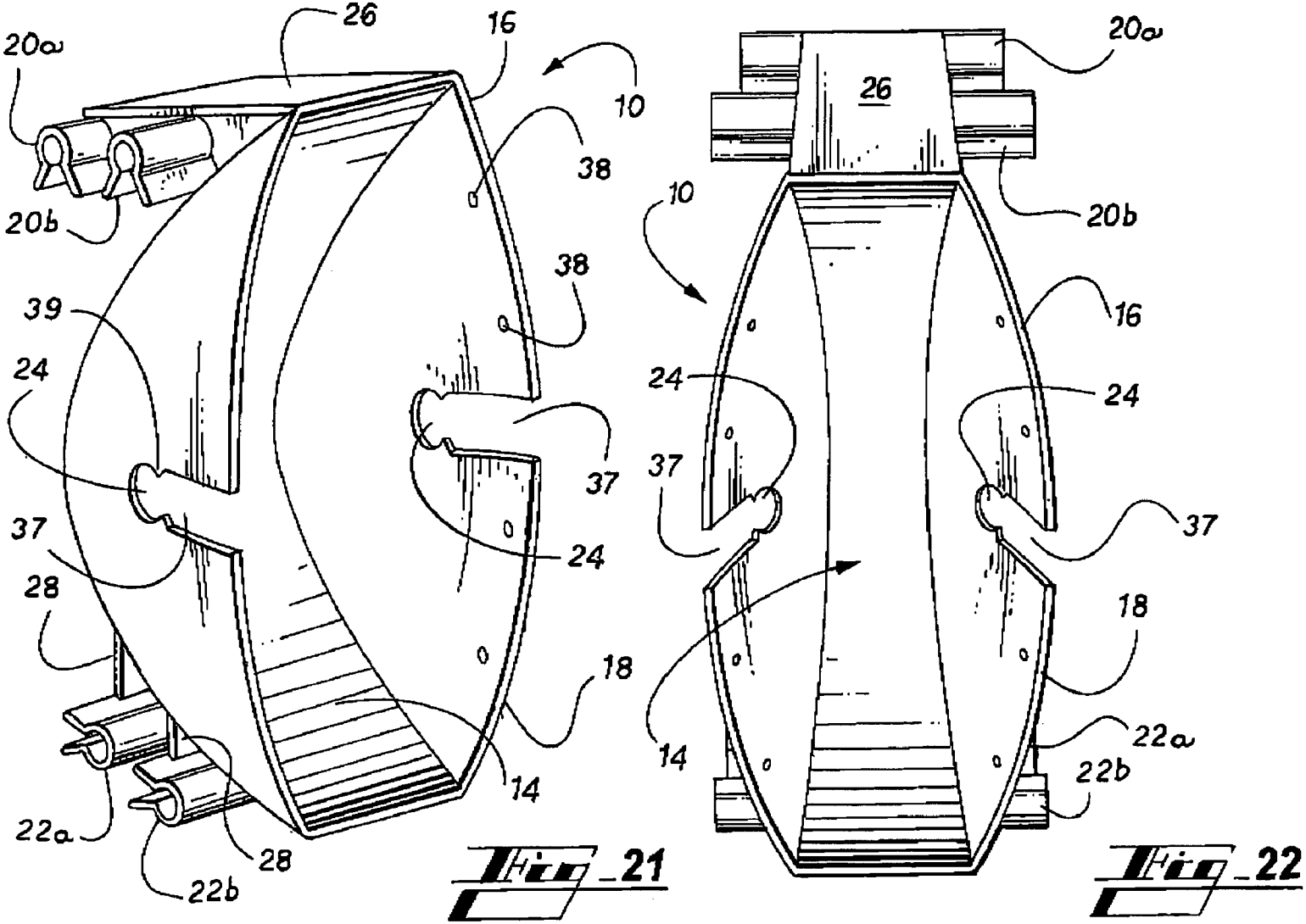
FIG. 21 is a perspective view of a slotted embodiment of the anchor recess former of the present invention.
FIG. 22 is a front view of the slotted embodiment of the present invention shown in FIG. 21.

Referring now to FIG. 21, a perspective view of a second, slotted, embodiment of the anchor recess former 10 of the present invention is shown. The anchor recess former 10 is a hollow, walled, generally cup- or half disc-shaped structure having an outer forming wall 12 and a hollow interior 14. The anchor recess former 10 preferably comprises single piece construction having upper rebar braces 20A, 20B, lower rebar braces 22A, 22B, and anchor holes 24. Upper rebar braces 20 are attached to the outer curved rear surface 44 (see FIG. 23) via upper brace supports 26 at an upper end 16 of the anchor recess former 10, and lower rebar braces 22 are attached to the outer curved rear surface 46 (see FIG. 23) via lower brace supports 28 at a lower end 18 of the anchor recess former 10. Anchor holes 24 extend through the anchor recess former 10 providing for a passage from the hollow interior 14 to the outside. Slots 37 are formed in the outer forming wall 12 and extend from the front edge 34 of the anchor recess former 10 and connect with anchor holes 24. Slots 37 preferably are as tall (wide) as the thickness (diameter) of the anchor 96 to allow the passage of anchor 96 through slots 37 to anchor holes 24. However, if anchor recess former 10 is constructed from a flexible material, slots can be shorter (narrower) and flex open during the passage of the anchor 96. Optional faceplate attachment dimples 38 allow faceplate 40 to be attached to the anchor recess former 10.

Referring now to FIG. 22, a front view of the slotted embodiment of the present invention is shown from a slightly elevated angle so as to show the top of the anchor recess former 10. From this view, it can be seen that anchor holes 24 are generally opposite each other across the hollow interior 14, preferably at a median portion of the anchor recess former 10. Slot 37 extends from the front edge 34 of the anchor recess former 10 and connect with anchor holes 24. A lip 39 preferably is provided at the interface between slot 37 and anchor hole 24 to retain anchor 94 within anchor holes 24 during use. Although opening 36 leading to hollow interior 14 is shown as an oval with flattened top and bottom, the shape of opening 36, and thus anchor recess former 10, is variable and not limited to the illustrative shape shown in the drawings.

Figures 23, 24, 25:
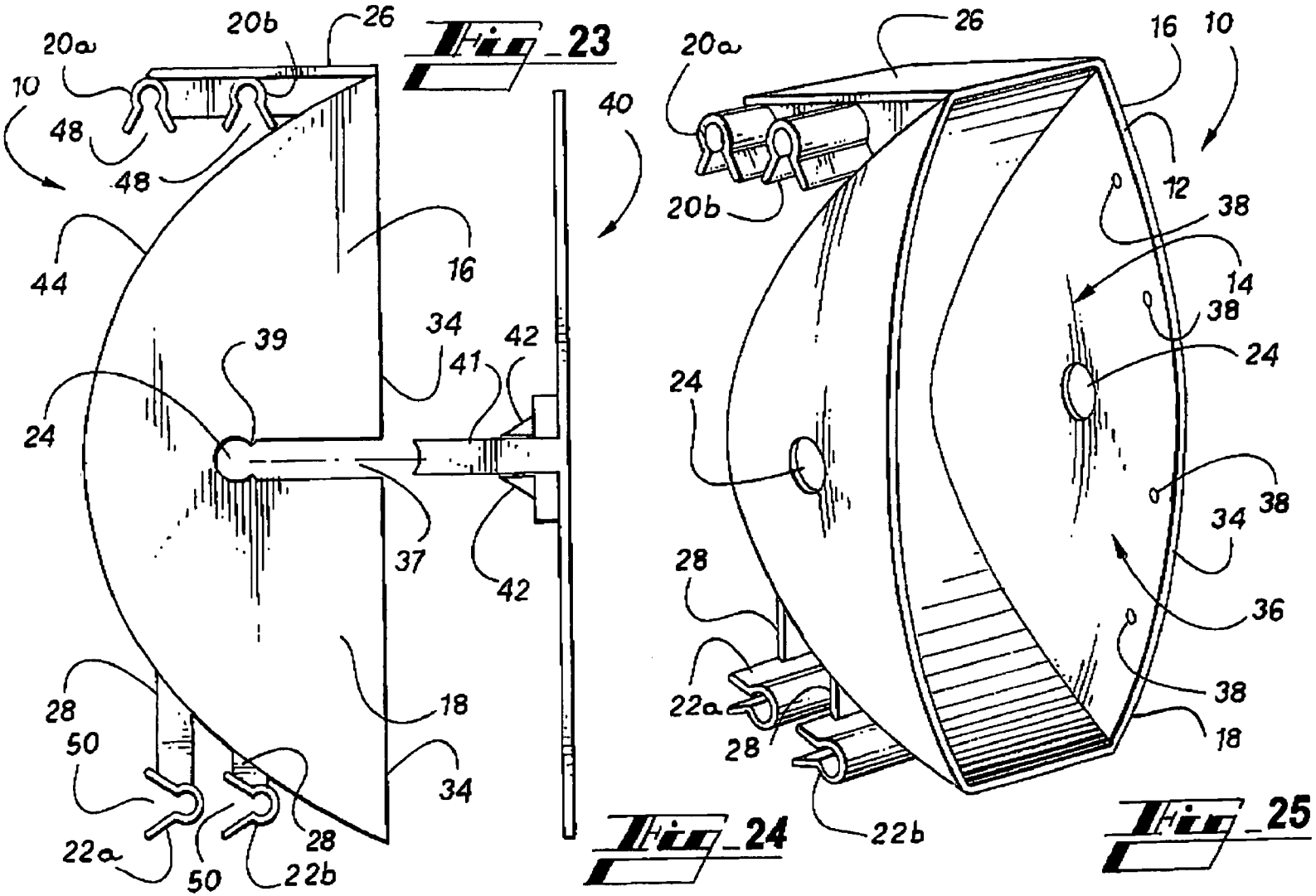
FIG. 23 is a side view of the slotted embodiment of the present invention shown in FIG. 21.
FIG. 24 is a side view of a faceplate for the slotted embodiment of the present invention show in FIG. 21.
FIG. 25 is a perspective view of another embodiment of the anchor recess former of the present invention.

Referring now to FIG. 23, a side view of the slotted embodiment of the present invention is shown. Upper brace supports 26 are attached to the outer curved rear surface 44 of the anchor recess former 10. Upper brace supports 26 extend horizontally rearwardly a predetermined distance from the front edge 34, thus supporting upper rebar braces 20 at specific distances from front edge 34. Similarly, lower brace supports 28 are attached to the outer curved rear surface 46 at a lower end of anchor recess former 10. Lower brace supports 28 extend vertically downwardly a predetermined vertical distance relative to the position of upper rebar braces 20 and a predetermined horizontal distance from front edge 34, thus supporting lower rebar braces 22A, 22B at specific distances from both corresponding upper rebar braces 20A, 20B and front edge 34. For reasons disclosed in connection with FIG. 17, upper open mouths 48 of upper rebar braces 20 open downwardly and lower open mouths 50 of lower rebar braces 22 open rearwardly. Front edge 34 in this embodiment is generally planar.

Figure 15:
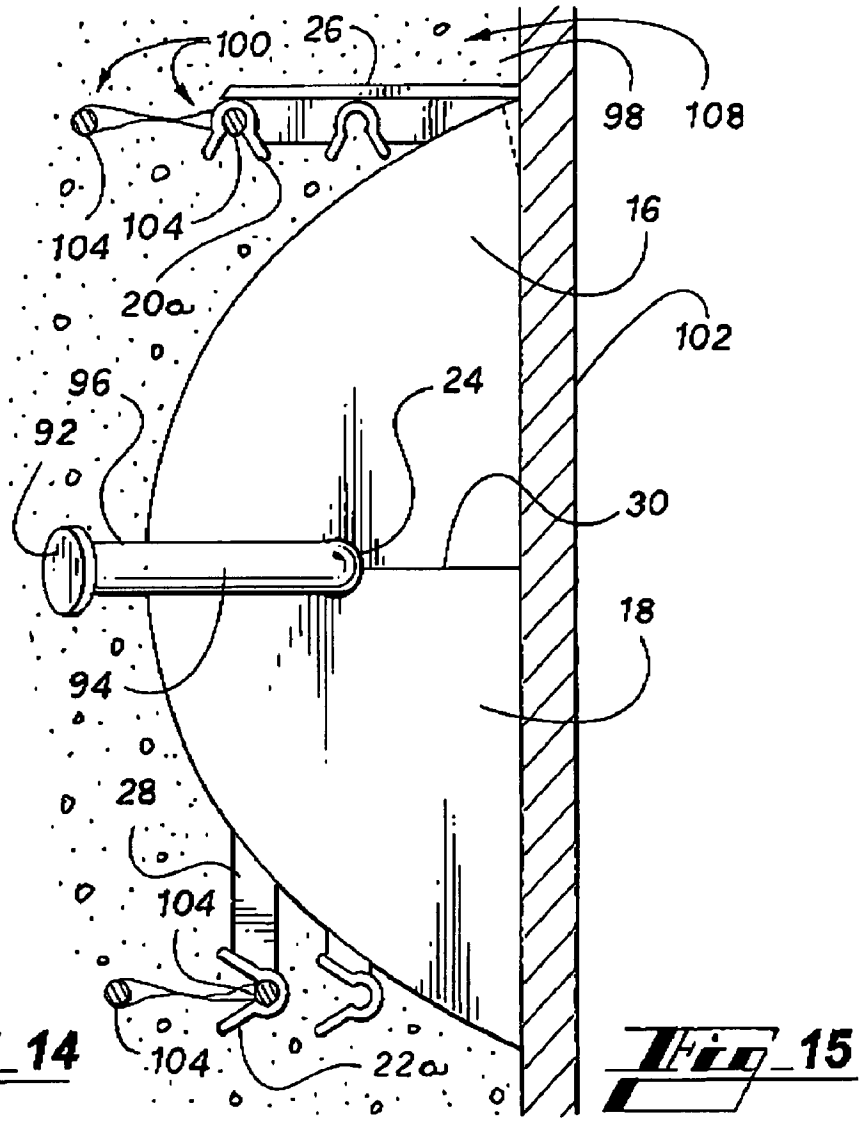
FIG. 15 is a side view of the embodiment of the present invention shown in FIG. 1 contained within a section of a concrete item and showing the concrete item form.

Referring now to FIG. 15, a side view of an embodiment of the present invention contained within a section of a concrete item 98 along with the concrete item form 100 is shown. Concrete item 98 is manufactured by pouring concrete 108 into a form 102 containing rebar pattern 100. Concrete 108 then cures (hardens) to form the final concrete item 98. Anchor recess former 10 is placed within and attached to rebar pattern 100 prior to placing rebar pattern 100 into concrete form 102, or prior to placing concrete form 102 over rebar pattern 100, whichever order is used. In this illustration, a larger concrete item 98 is being manufactured, calling for a rebar pattern 100 in which the outermost piece of rebar 104 is to be located within the concrete item 98 2" from the external edge of the concrete item 98, that is 2" from the form 102. Thus, the anchor recess former 10 is attached (hung on) rebar pattern 100, specifically rebar 104, using first upper rebar brace 20A and first lower rebar brace 22A, such that front edge 34 coincides with (is proximal to and preferably flush against) the external edge of concrete item 98, and is proximal to, and preferably flush against, the inside surface of form 102. Portions of anchor 94, namely portions of shanks 94 and stops 92, thus are embedded within concrete 108 and secure anchor 96 within concrete item 98. Second upper rebar brace 20B and second lower rebar brace 22B are not used in this situation.

Notch 52 is shown relative to form 102 to illustrate that if form 102 is slid down over rebar pattern 100 including attached anchor recess former 10, form 102 can more easily slide over the notch 52 and not catch on the upper edge of front edge 34. Additionally, notch 52 can act as an aligning feature. After anchor recess former 10 has been attached to rebar pattern 100, anchor recess former 10 may be somewhat off from vertical. As form 102 is lowered over rebar pattern 100, form 102 can contact notch 52 and, rather than catching on the top edge of anchor recess former 10, and help to align anchor recess former 10 relative to form 102.

Figure 16:
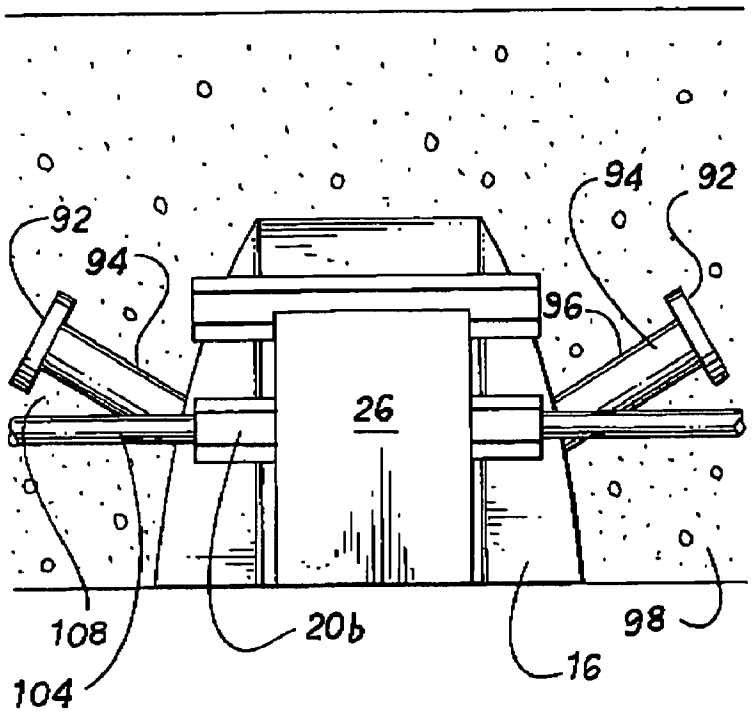
FIG. 16 is a top view of the embodiment of the present invention shown in FIG. 1 contained within a section of a concrete item.

Referring now to FIG. 16, a top view of an embodiment of the present invention contained within a section of a concrete item 98 is shown. In this illustration, a smaller concrete item 98 is being manufactured, calling for a rebar pattern 100 in which the outermost piece of rebar 104 is to be located within the concrete item 98 1" from the external edge of the concrete item 98, that is 1" from the form 102. Thus, the anchor recess former 10 is attached (hung on) rebar pattern 100, specifically rebar 104, using second upper rebar brace 20B and second lower rebar brace 22B, such that front edge 34 coincides with (is proximal to and preferably flush against) the external edge of concrete item 98, and is proximal to, and preferably flush against, the inside surface of form 102. First upper rebar brace 20A and first lower rebar brace 22A are not used in this situation.

Figure 17:
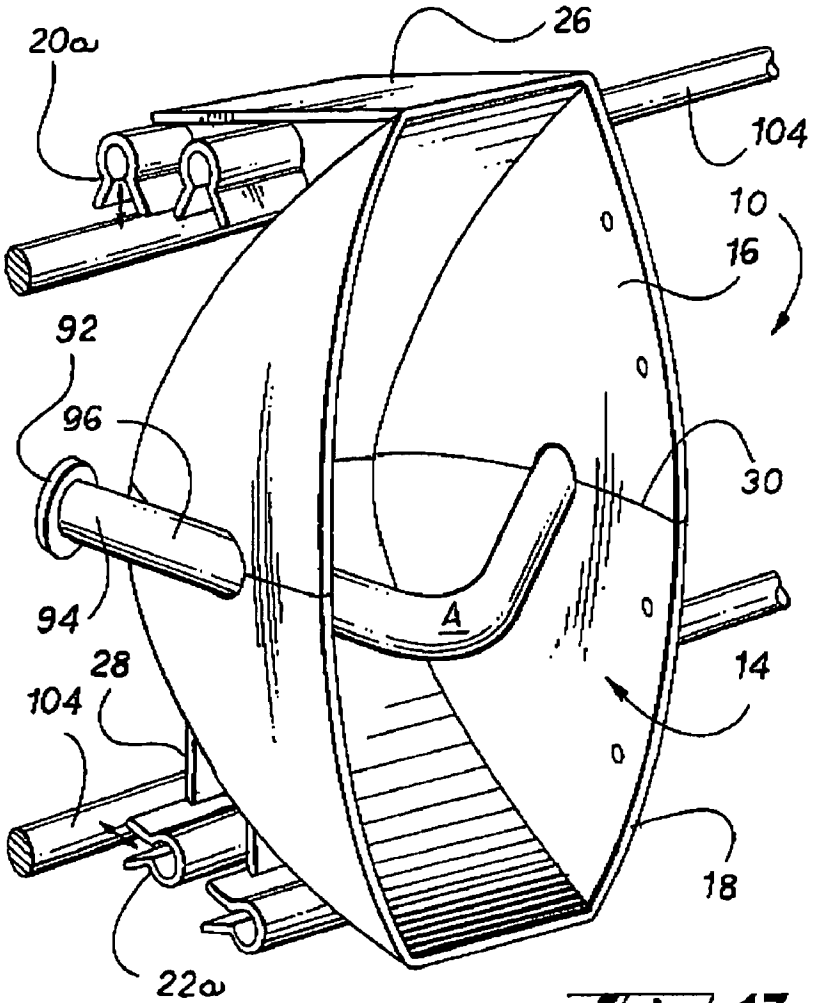
FIG. 17 is a perspective view of the embodiment of the present invention shown in FIG. 1 with an anchor and being placed on the reinforcement bar for a concrete item.

Referring now to FIG. 17, a perspective view of an embodiment of the present invention with an anchor 96 and being placed on the reinforcement bar 104 for a concrete item 98 is shown. After rebar pattern 100 has been constructed, but prior to rebar pattern 100 being placed in form 102 (or form 102 being placed over rebar pattern 100), and prior to concrete 108 being poured into form 102, and preferably after anchor 96 has been inserted into anchor recess former 10, anchor recess former 10 is attached to rebar pattern 100. Upper rebar brace 20 is placed on rebar 104 so as to support anchor recess former 10 on rebar 104. First upper rebar brace 20A or second upper rebar brace 20B (or other upper rebar braces 20, not shown, if more than two upper rebar braces are present) properly positions anchor recess former 10 the necessary distance such that front edge 34 coincides with the external surface of concrete item 98, and prevents or reduces lateral movement of anchor recess former 10. Lower rebar brace 22A is placed on rebar 104 so as to position anchor recess former 10 on rebar pattern 100 such that front edge 34 is generally vertical. First lower rebar brace 22A or second lower rebar brace 22B (or other lower rebar braces 22, not shown, if more than two lower rebar braces are present) also properly positions anchor recess former 10 both vertically, as previously disclosed, the necessary distance such that front edge 34 is generally vertical and coincides with the external surface of concrete item 98, and prevents or reduces up and down movement of anchor recess former 10.

In an illustrative example, open mouths 48, 50 are structured to allow ease of insertion of rebar 104 into braces 20, 22. More specifically, open mouths 48, 50 can have an angled opening wider than the thickness (diameter) of rebar 104. The internal U-shaped interior of braces 20, 22 preferably has a diameter or size that generally corresponds to the thickness (diameter) of rebar 104 such that braces 20, 22 engage rebar 104 frictionally or clamp-like, so as to relatively securely hold anchor recess former 10 on rebar 104. More specifically, it is desired that anchor recess former 10 be mounted on rebar pattern 100 sufficiently securely to prevent anchor recess former 10 from falling off of rebar pattern 100 during the concrete item 98 manufacturing process.

Figure 18:
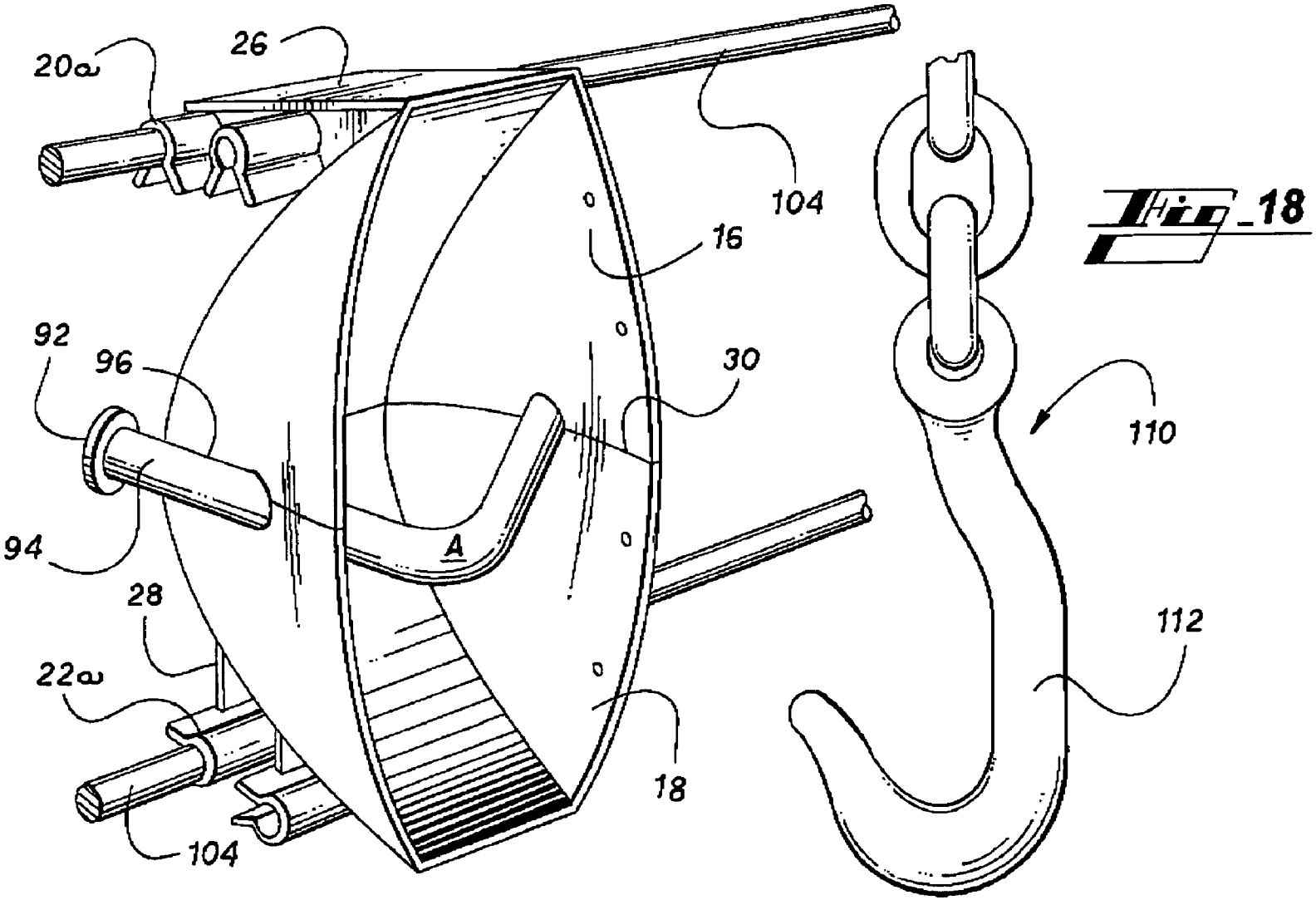
FIG. 18 is a perspective view of the embodiment of the present invention shown in FIG. 1 with an anchor after being placed on the reinforcement bar for a concrete item and showing how a lifting assembly cooperates with the anchor.
Figure 19:
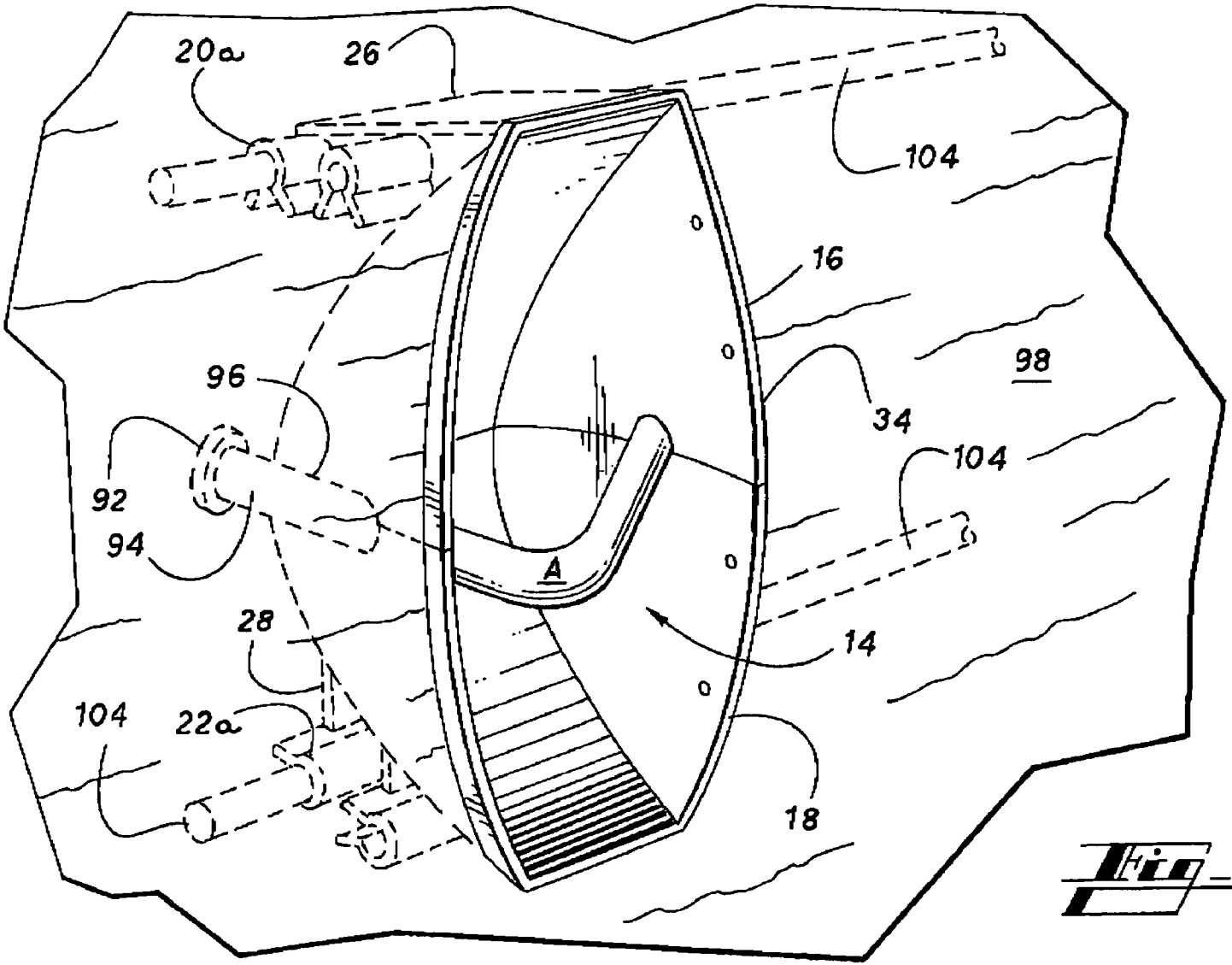
FIG. 19 is a perspective view of the embodiment of the present invention shown in FIG. 1 with an anchor after being placed on the reinforcement bar for a concrete item and cured within the concrete item.

Referring now to FIG. 18, a perspective view of an embodiment of the present invention with an anchor 96 after being placed on the reinforcement bar 104 for a concrete item 98, along with a lifting assembly 110 cooperating with the anchor 96, is shown. Although concrete item 98 is not shown in this figure, this figure represents the anchor recess former 10 already encased in the concrete item 98, as shown in FIG. 19, with front edge 34 flush with the external surface of concrete item 98 and hollow interior 14 open to the outside. Anchor 96 is securely embedded in concrete item 98 and apex A is located within hollow interior and is available for cooperating with lifting assembly 110. Specifically, a hook 112 can hook anchor 96 to lift concrete item 98/

Referring now to FIG. 19, a perspective view of an embodiment of the present invention with an anchor 96 after being placed on the reinforcement bar 104 for a concrete item 98 and cured within the concrete item 98 is shown. Front edge 34 is flush, or nearly so, with the external surface of concrete item 34. More than one anchor recess former 10 can be manufactured into a concrete item.

Figure 20:
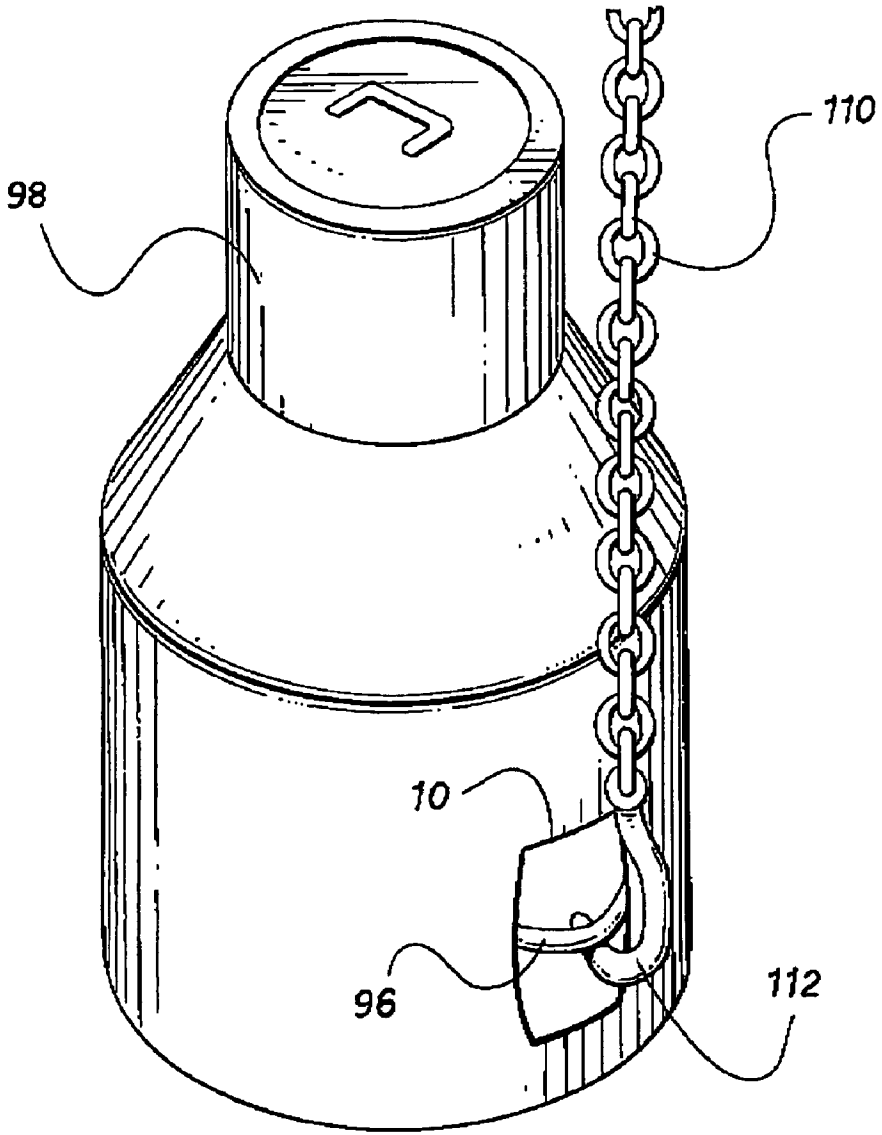
FIG. 20 is a perspective view of a concrete item having an embodiment of the present invention and being lifted by a lifting assembly.

Referring now to FIG. 20, a perspective view of a concrete item 98 having an embodiment of the present invention and being lifted by a lifting assembly 110 is shown. The scale of anchor recess former 10 is not exact, but is shown enlarged relative to a concrete item 98 for better detail. Hook 112 of lifting assembly 110 has engaged anchor 96 and now can lift concrete item. Lifting assembly 110 is part of or can be attached to, for example, a crane (not shown).

Referring now to FIG. 25, a perspective view of another embodiment of the anchor recess former of the present invention lacking a split 30 (see FIG. 1) and a slot 37 (see FIG. 21) is shown. This is a simple version of the invention in which the anchor 96 is installed into the anchor recess former 10 by inserting the end of the anchor through the anchor holes 24. In such an embodiment, anchor holes 24 preferably are at least as large (diameter) as stops 92, or stops 92 preferably are eliminated form anchor 96. Both of these options are less desirable than the split embodiment and the slot embodiment of the present invention. Having anchor holes 24 larger than the diameter of the anchor 96 rod allows space between anchor 96 and anchor holes 24 when anchor 96 is in proper position, which would allow concrete to 108 to enter the hollow interior 14 through this space. Eliminating the stops 92 may lower the strength of the connection between the cured concrete 108 and the anchor 96. Not having a split 30 or slot 37 lowers the ease of placing the anchor 96 into the anchor recess former 10. And, although plugs (not shown) could be used to close the space between the anchor 96 and the anchor holes 24, this would add complexity to the structure of the invention and to the method for placing the anchor 96 into the anchor recess former 10.

Referring to FIGS. 15, 17, and 20 in operation and use, a anchor recess former 10 is manufactured into a concrete item 98 in accordance with the disclosure in connection with FIG. 17. During the manufacturing process, faceplate 40 preferably is maintained on anchor recess former 10 to prevent concrete 108, water, other debris from entering hollow interior 14. If a slotted embodiment of the invention is utilized, the faceplate 40 shown in FIG. 24 should be utilized and will preferably have inwardly extending arms 41 so as to cover the slot openings 37, shown by the dashed line, to avoid infiltration of the poured concrete into the hollow interior of the anchor recess former 10. An anchor alignment post 42 preferably is provided on the surface of the faceplate 40 facing the hollow interior of the anchor recess former 10 to retain the apex A in proper alignment with respect to the anchor holes 24, anchor recess former 10 and concrete item 98 during pouring and setting of the concrete. Once concrete item 98 has been manufactured, upon the need to lift concrete item 98, faceplate 40 is removed and lifting assembly 110 is used to lift concrete item 98. Concrete item 98 then can be placed on a truck for transportation, or moved or removed to a desired location.

Variations and alternatives to the size and structure of the anchor recess former 10 are contemplated. For example, the illustrative embodiment has two braces 20, 22 located 1" and 2" from the front edge 34 as this is the conventional sizing for concrete items. If manufacturing standards change, or if it is desired to have the front edge 34 recessed or protruding relative to the external surface of the concrete item 98, then braces 20, 22 can be located at different distances from front edge 34. For another example, anchor recess former 10 can be manufactured with only one of each brace 20, 22 or three or more of each brace 20, 22. Additionally, for even larger concrete items, the anchor recess former 10 can have a greater size (dimensionally) so as to accommodate a larger anchor 96 and larger lifting assemblies 110.

Using this invention, the anchor recess former 10 can be hooked directly to the rebar 104 and manufactured with the concrete item 98, such that a hole need not be made in the concrete item 98 after manufacture for lifting. Additionally, the use of the present invention can save manufacturing time as the braces 20, 22 are located relative to the standard rebar pattern 100 and the anchor recess former 10 can be hooked directly and easily at the proper location on the rebar pattern. This eliminates the uncertainty of whether a magnet-based recess anchor recess former will remain on the rebar during the manufacturing process, as well as the cost of the magnet. Further, the current rubber recess anchor recess formers are removed prior to installation of the concrete item, while the present invention can remain a part of the concrete item.

By having two braces 20, 22, namely two upper rebar braces 20A, 20B and two lower rebar braces 22A, 22B, one anchor recess former 10 can be used in the manufacture of approximately 90% of all concrete items typically utilizing such an anchor recess. Additionally, the use of the upper rebar braces 20 and the lower rebar braces 22 positions the anchor recess former 10 properly saving on installation time, and preventing the formation of crooked recesses. Crooked recesses can cause cracking of the concrete item upon lifting, filling of the recess with concrete during manufacture, and uneven placement of the concrete item upon use.

As the present invention is manufactured with the concrete item, it reduces the amount of water that can seep under the anchor recess former 10. Further, by remaining in the concrete item, the present invention can help prevent damage to the recess by the lifting assembly. The use of the faceplate 40 helps prevent water from entering the recess, which can corrode the steel anchor, or which can freeze in cold temperatures and need to be chipped out of the recess.

The above detailed description of the preferred embodiments, examples, and the appended figures are for illustrative purposes only and are not intended to limit the scope and spirit of the invention, and its equivalents, as defined by the appended claims. One skilled in the art will recognize that many variations can be made to the invention disclosed in this specification without departing from the scope and spirit of the invention.

What is claimed is:

1. An anchor recess former comprising:

an outer forming wall and a hollow interior;

the outer forming wall being a hollow generally cup- or half disc-shaped structure having side walls, a curved rear surface wall connecting the side walls together, and a front edge located along a contiguous portion of the side walls and the rear surface wall;

the hollow interior being accessible via a frontal opening;

the side walls comprising anchor holes located therethrough for retaining an anchor;

means for allowing an anchor to be received in the anchor holes; and at least one upper rebar brace and at least one lower rebar brace for attaching the anchor recess former to a rebar pattern used to manufacture a concrete item, wherein the at least one upper rebar brace is attached to an upper portion of the outer side of the rear surface wall and extends horizontally rearwardly a predetermined distance from the front edge and the at least one lower rebar brace is attached to a lower portion of the outer side of the rear surface wall and extends vertically downwardly a predetermined vertical distance relative to the at least one upper rebar brace;

wherein the at least one upper rebar brace comprises a downwardly facing open mouth and the at least one lower rebar brace comprises a rearwardly facing open mouth for holding the anchor recess former on the rebar pattern.

2. The anchor recess former of claim 1, wherein the means for allowing an anchor is selected from the group consisting of:

(a) structuring the outer forming wall to comprise an upper section and a lower section that are separable from each other;

(b) structuring the outer forming wall to comprise an upper section and a lower section that are pivotably connected to each other;

(c) structuring the outer forming wall to comprise an upper section and a lower section that are otherwise openable relative to each other; and (d) structuring the outer forming wall as a unitary construction and the side walls comprise a slot extending from the front edge to the anchor holes, so as to allow the placement of the anchor within the anchor holes in a proper position with an anchor apex and portions of anchor shanks located within the hollow interior and portions of the anchor shanks and anchor stops located outside of the device.

3. The anchor recess former as claimed in claim 1, further comprising a faceplate covering the frontal opening.

4. The anchor recess former as claimed in claim 3, wherein the means for allowing an anchor is structured such that the outer forming wall comprises the upper section and the lower section that are separable from each other and the faceplate releasably connects the upper section to the lower section.

5. The anchor recess former as claimed in claim 3, wherein the means for allowing an anchor is structured such that the outer forming wall comprises the upper section and the lower section that are separable from each other and the faceplate releasably and pivotably connects the upper section to the lower section.

6. The anchor recess former as claimed in claim 3, wherein the means for allowing an anchor is structured such that the outer forming wall comprise the upper section and the lower section that are pivotably connected to each other via a hinge located along a front edge of the side wall.

7. The anchor recess former as claimed in claim 3, wherein the means for allowing an anchor is structured such that the outer forming wall comprises the upper section and the lower section that are otherwise openable relative to each other and the faceplate releasably connects the upper section to the lower section.

8. The anchor recess former as claimed in claim 3, wherein the means for allowing an anchor is structured such that the outer forming wall comprises the upper section and the lower section that are otherwise openable relative to each other and the faceplate releasably and pivotably connects the upper section to the lower section.

9. The anchor recess former as claimed in claim 1, further comprising two upper rebar braces attached to the upper portion of the outer side of the rear surface wall and two lower rebar braces are attached to the lower portion of the outer side of the rear surface wall, wherein a first of two upper rebar braces and a first of the two lower rebar braces are both located a first distance from the front edge and a second of two upper rebar braces and a second of the two lower rebar braces are both located a second distance from the front edge.

10. The anchor recess former as claimed in claim 1, further comprising two upper rebar braces attached to the upper portion of the outer side of the rear surface wall and two lower rebar braces attached to the lower portion of the outer side of the rear surface wall, wherein a first of two upper rebar braces and a first of the two lower rebar braces are both located a first distance from the front edge and a second of two upper rebar braces and a second of the two lower rebar braces are both located a second distance from the front edge.

11. An anchor recess former comprising:

an outer forming wall and a hollow interior;

the outer forming wall being a hollow generally cup- or half disc-shaped structure having side walls, a curved rear surface wall connecting the side walls together, and a front edge located along a contiguous portion of the side walls and the rear surface wall;

the hollow interior being accessible via a frontal opening;

the side walls comprising anchor holes located therethrough for retaining an anchor;

means for allowing an anchor to be received in the anchor holes; and two upper rebar braces and two lower rebar braces for attaching the anchor recess former to a rebar pattern used to manufacture a concrete item, wherein the two upper rebar braces are attached to an upper portion of the outer side of the rear surface wall and extend horizontally rearwardly a predetermined distance from the front edge and the two lower rebar braces are attached to a lower portion of the outer side of the rear surface wall and extend vertically downwardly a predetermined vertical distance relative to the two upper rebar braces, and wherein the two upper rebar braces each comprise a downwardly facing open mouth and the two lower rebar braces each comprise a rearwardly facing open mouth for holding the anchor recess former on the rebar pattern.

12. The anchor recess former of claim 11, wherein the means for allowing an anchor is selected from the group consisting of:

(a) structuring the outer forming wall to comprise an upper section and a lower section that are separable from each other;

(b) structuring the outer forming wall to comprise an upper section and a lower section that are pivotably connected to each other;

(c) structuring the outer forming wall to comprise an upper section and a lower section that are otherwise openable relative to each other; and (d) structuring the outer forming wall as a unitary construction and the side walls comprise a slot extending from the front edge to the anchor holes, so as to allow the placement of the anchor within the anchor holes in a proper position with an anchor apex and portions of anchor shanks located within the hollow interior and portions of the anchor shanks and anchor stops located outside of the device.

13. The anchor recess former as claimed in claim 11, further comprising a faceplate covering the frontal opening.

14. The anchor recess former as claimed in claim 12, wherein the means for allowing an anchor is structured such that the outer forming wall comprises the upper section and the lower section that are separable from each other and the faceplate releasably connects the upper section to the lower section.

15. The anchor recess former as claimed in claim 12, wherein the means for allowing an anchor is structured such that the outer forming wall comprises the upper section and the lower section that are separable from each other and the faceplate releasably and pivotably connects the upper section to the lower section.

16. The anchor recess former as claimed in claim 12, wherein the means for allowing an anchor is structured such that the outer forming wall comprise the upper section and the lower section that are pivotably connected to each other via a hinge located along a front edge of the side wall.

17. The anchor recess former as claimed in claim 12, wherein the means for allowing an anchor is structured such that the outer forming wall comprises the upper section and the lower section that are otherwise openable relative to each other and the faceplate releasably connects the upper section to the lower section.

18. The anchor recess former as claimed in claim 12, wherein the means for allowing an anchor is structured such that the outer forming wall comprises the upper section and the lower section that are otherwise openable relative to each other and the faceplate releasably and pivotably connects the upper section to the lower section.

* * * * *